United States Patent [19]

Mattingly, Jr.

[11] 4,182,542

[45] Jan. 8, 1980

[54] CLIPLESS CONTACT

[75] Inventor: William R. Mattingly, Jr., Santa Ana, Calif.

[73] Assignee: Matrix Science Corporation, Torrance, Calif.

[21] Appl. No.: 923,263

[22] Filed: Jul. 10, 1978

[51] Int. Cl.[2] ..... H01R 13/42

[52] U.S. Cl. ..... 339/217 S

[58] Field of Search ..... 339/256 R, 217 R, 217 S

[56] References Cited

U.S. PATENT DOCUMENTS

| | | | |
|---|---|---|---|
| 3,028,574 | 4/1962 | DiMonte | 339/61 |
| 3,158,424 | 11/1964 | Bowen | 339/217 |
| 3,335,396 | 8/1967 | Nava et al. | 339/217 |
| 3,396,364 | 8/1968 | Bonhomme | 339/217 S |
| 3,783,440 | 1/1974 | Karube et al. | 339/217 S |

FOREIGN PATENT DOCUMENTS

| | | | |
|---|---|---|---|
| 217371 | 2/1957 | Australia | 339/185 R |
| 811825 | 4/1959 | United Kingdom | 339/256 R |

*Primary Examiner*—Neil Abrams

*Attorney, Agent, or Firm*—Nilsson, Robbins, Dalgarn, Berliner, Carson & Wurst

[57] ABSTRACT

A connector assembly and method of making the same. A connector member, which may be either a socket or pin, has a front mating portion adapted to engage a reciprocal mating portion of a second connector; a tubular electric wire retaining portion into which a wire is inserted and held; and a rear elliptically cross-sectioned retention portion which is resiliently deformable to a circular cross section. The connector member is inserted into a circular cross-sectioned passageway in an insulating support assembly, the passageway having a central region with a larger diameter to define an interior protruding shoulder. As the connector member is inserted into the insulating support assembly passageway, the rear retention portion is deformed to a circular cross section conforming to the interior surface of the passageway. When the end passes the interior protruding shoulder, the rear retention portion returns to an elliptically cross-sectioned shape with the shoulder thereafter preventing withdrawl from the passageway. A chamfered, longitudinally split tube tool may be inserted to force the rear retention portion into a circular shape whereupon the connector member may be moved past the shoulder and removed from the insulating assembly.

5 Claims, 4 Drawing Figures

CLIPLESS CONTACT

BACKGROUND OF THE INVENTION

This invention relates to electrical connectors and, in particular, to apparatus for retaining one or more contact terminals in an insulation body without the necessity of incorporating a separate retention member for each contact terminal.

Structural connector designs which may be inserted into the bore of an insulation block from the rear face and locked in the bore against axial movement in either direction and which are then removable by the insertion of a tool into the entry location to withdraw the electrical connector are known in the art. For example, such a connector system is disclosed in U.S. Pat. No. 3,158,424, filed July 25, 1961, in which a sleeve insert having a retaining clip is inserted into the insulation body passageway with the contact terminal, either a jack or a plug, being held in place in the insulation block passageway by the sleeve insert clip. While the clip in this invention could be moved upward thereby allowing the connector terminal to be withdrawn and replaced, this connector device required a separate sleeve insert which was a third element thereby complicating the assembly procedure and increasing the expense.

Similarly functioning clip mechanisms are disclosed in U.S. Pat. Nos. 3,335,396 and 3,028,574, each requiring a separate clip member similar to that disclosed in U.S. Pat. No. 3,158,424 discussed above. By contrast, the present invention requires no such clip portion and, indeed, does not require a separate sleeve insert or any other insert or clip since the retaining function is integrally incorporated as a part of the contact terminal itself in cooperation with a shoulder portion in the insulation body passageway.

In U.S. Pat. No. 3,396,364, an electrical socket member is disclosed which has an intermediate portion which is deformed in such a way that a resilient deformation occurs upon the insertion of a pin to provide a strong electrical contact. One embodiment of this invention discloses an end portion having a first generally circular edge and a second generally elliptical edge connected by a continuous surface to define a generally conical form. As the circular edge is inserted into the passsageway in the insulating block, the continuous surface is disclosed as being generally and progressively deformed to assume the shape of the circular front edge along the entire length until the rear edge passes a shoulder whereupon the rear edge springs back to its original elliptical form with the rear edge abutting against the shoulder preventing the contact from being withdrawn from the passageway. Although this apparatus allows the elimination of a separate sleeve incorporating a clip, the configuration shown still requires a third cylindrically shaped part which must be affixed to the end of the connector socket. Thus, even though the clip is eliminated, the referenced device would still require an additional part and would thus entail many of the problems of fabrication previously encountered.

In addition, the device disclosed in the above patent requires that the connector between the end section and the socket portion be reinforced and made strong so that the end portion would not detach from the socket portion allowing the socket portion to be removed from the passageway and the insulator block. Clearly, such a junction between the end portion and the socket portion would be effected by the continual deformation from an elliptical to a circular cross section as the pin was inserted and removed. Such a flexing motion would amplify the possibility of the head coming loose and thereby causing electrical contact to be broken.

It will also be appreciated that in the configuration of the above-disclosed reference, the contact terminal is rear insertable but can only be released by inserting a tool in the front and then pulling the connector through the rear of the insulating block. By contrast, the present invention is rear insertable and rear releasable without the necessity of accessing the front of the connector thereby facilitating removal of individual contact terminals.

Yet another distinction between the present invention and the cited reference is that the cited reference described an insert cavity configuration having a front and rear diameter larger than the center diameter with the clip action being in the front diameter after passing through the rear and center diameters. In such a scheme, the clip area is exposed. By contrast, the present invention has a front and rear diameter which is smaller than the center diameter with the spring section of the contact being completely housed in the center section. Thus, the spring or clip section of the contact terminal is not exposed after insertion.

Still another distinction is that the present invention may be made of a single member by simply permanently deforming one end of a tubular structure to assume an elliptical shape. The member is then made of a material which can be resiliently deformed to assume a circular shape as it passes through a circular passageway in the insulating block and thereafter returns to the elliptical shape when the deformed portion is in place in a central larger diameter circular passageway portion. The primary purpose of the disclosed connector in the above reference is to provide a tight electrical contact by collapsing the circular connector portion to two substantially parallel sections adjacent to one another to provide a spring action when a male plug is inserted between the two sections. To provide such a jack function and at the same time, with the same tubular member, provide elliptical cross section immediately next to the collapsed portion as in the present invention would be difficult, if not impossible. Even if possible, however, the resultant connection would be very difficult to insert and even more difficult to remove from the insulation passageway.

Finally, because the insertion of a mating member causes the elliptical edge portion at the ends of the major diameter to be pushed against a shoulder, no abutment portions are required in the present invention as is required by the embodiment disclosed in the above-identified reference, since in that case the insertion of a pin (at least in one direction) causes the edge portions at the ends of the major axis of the elliptical edge region to be pushed away from the shoulder portion. In view of these substantial differences, it is clear that the above-cited reference not only does not disclose the present invention but teaches away from it. The present invention thus provides a novel and advantageous advance in the art of contact terminals and electrical connectors and, in particular, provides a simplified, less expensive and more reliable connector assembly than those previously provided and, in particular, than that provided by U.S. Pat. No. 3,396,364.

BRIEF DESCRIPTION OF THE DRAWINGS

The invention will be better understood from the detailed description below taken in conjunction with the drawings wherein like reference characters refer to like parts throughout and in which.

DETAILED DESCRIPTION OF THE PREFERRED EMBODIMENT

Figure 1:
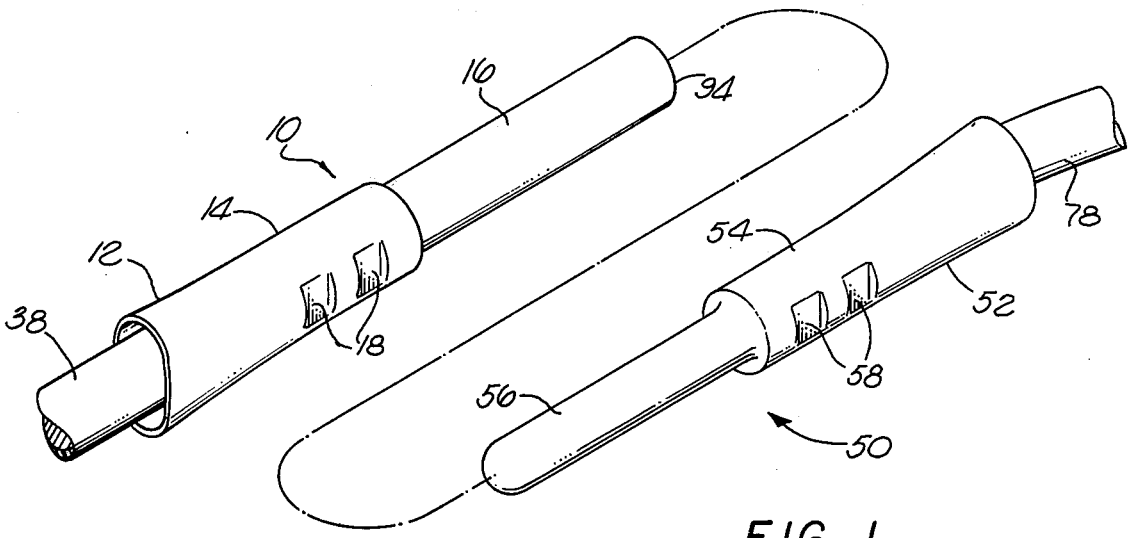
FIG. 1 is a perspective view of a socket contact terminal and a plug contact terminal in accordance with the present invention.

Referring first to FIG. 1, there is shown a socket or jack member 10 which is preferably a unitary member having a socket retention portion 12, a socket electrical contact portion 14 and a pin receptor portion 16. The socket member 10 is tubular in shape having a hollow cavity or passageway therethrough. In accordance with the present invention, the socket retention portion 12 is permanently configured to assume an elliptical cross section which is then resiliently deformable to a circular cross-sectional shape.

A socket wire 38 is then inserted through the socket retention portion 12 into the socket electrical contact portion 14 where the wire 38 is retained by depressing the socket crimps 18. Of course, it will be appreciated that other wire retention means other than socket crimps may be utilized without departing from the present invention. In the preferred embodiment, the end of the wire 38 does not extend into the pin receptor region 16 thereby preserving a hollow region into which a pin may be inserted to make an electrical contact.

In a similar fashion, a pin member 50, which is preferably a unitary member, has a pin retention portion 52, a pin electrical contact portion 54 and a pin engagement portion 56. In the preferred embodiment, the pin retention portion and the pin electrical contact portion 54 are tubular allowing a wire 78 to be inserted through the pin retention portion 52 and the pin electrical contact portion 54. Pin crimps 58 may be depressed to hold the wire 78 in the electrical contact portion 54. The pin engagement portion 56 may be an extension of the tubular member from which the pin member is made or may be a solid pin.

In a manner similar to that described in conjunction with the socket retention portion 12, the pin retention portion 52, which is initially circular in cross section, is permanently configured to assume an elliptical cross-sectional shape which is resiliently deformable to a circular cross-sectional shape.

In operation, the pin engagement region 56 of the pin member 50 is inserted into the pin receptor region 16 of the socket 10 to provide an electrical contact between the wires 38 and 78. In order to facilitate the electrical contact, it is preferable that the pin receptor region 16 be permanently configured to an elliptical cross-sectional shape. The cross section of the pin engagement region 56 is then preferably circular having an outside diameter equal to or just slightly smaller than the inside diameter of the pre-configuration circular cross section of the pin receptor region 16. Thus, when the circular pin engagement region 56 is inserted into the elliptical cross-sectioned pin receptor region 16, the pin receptor region 16 resiliently deforms outwardly to wrap around the pin engagement region surface to thereby provide a secure, low-resistance electrical contact.

Figure 2:
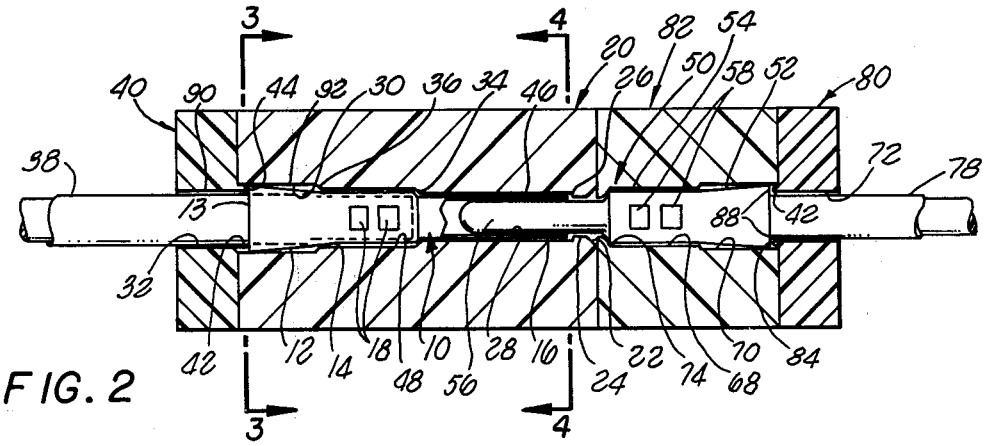
FIG. 2 is a cross-sectional plan view of the socket and plug members as they are assembled in an insulation body.

Since it is one objective of the present invention to provide an easily insertable and easily removable socket and pin member for use in a connector having multiple sockets and multiple pins arranged in a single, insulated retainer or mount, the operation of the present invention may be best understood by reference to FIG. 2, which illustrates a single pin and a single socket member in place in an insulating connector mounting which may, for example, be made of plastic. Thus, in FIG. 2, a front socket insulator portion 20 is shown having a cavity or passageway therethrough. The cavity through the front socket insulator portion 20 has several regions, each having a circular cross section including a front conical receiving portion 22 for receiving and guiding the pin engagement region 56 of the pin member 50. The front conical receiving portion 22 connects to a cylindrical support portion 24 which has a diameter approximately equal to the diameter of the pin engagement region 56 of the pin member 50. The cylindrical support portion 24 is joined by an end shoulder 26 to a front cavity portion 28 in which the pin receptor region 16 and the socket electrical contact portion 14 of the socket 10 reside when the socket member 10 is in place in the front socket insulator portion 20.

In the embodiment illustrated in FIG. 2, the front passageway portion 28 has a front, small diameter engagement passageway portion 46 connected to a larger diameter electrical contact passageway portion 48 by a secondary front shoulder 34. The socket engagement portion 16 is then positioned in the engagement passageway portion 46 while the socket electrical contact portion 14 is positioned in the electrical contact passageway portion 48.

In the preferred embodiment, the socket electrical contact portion 14 has a greater circular cross-section diameter than the pre-configured circular cross-section diameter of the socket engagement region 16. Thus, the junction between the socket electrical contact portion 14 and the pin receptor region 16 provides a lip which engages the secondary front shoulder 34 to prevent the socket member 10 from extending or being pushed through the front of the insulator member 20. A primary front shoulder portion 36 also exists between the central cavity portion 30 and the electrical contact portion 48 since the diameter of the central cavity portion 30 will be larger than the diameter of the electrical contact passageway portion 48.

Also provided is a rear insulator member 40 which has a circular passageway therethrough having a diameter which is less than the diameter of the central cavity portion 30. At the front end of the rear insulator portion 40 is a circular lip 42 which is adapted for being inserted into the rear opening of the central cavity portion 30. When so inserted, the passageway through the rear insulator 40 defines a rear passageway portion 32 with the end of the circular lip defining a rear shoulder 44.

In order to assemble the insulator member and the socket member 10, the electrical wire 38 is first inserted into place in the hollow socket electrical contact portion 14 and crimped utilizing the socket crimps 18. The socket member 10 is then inserted through the rear cavity portion 32 of the insulator assembly comprised of the front socket insulator 20 and the rear socket insulator 40. As the socket connector is inserted, the elliptical socket retention portion 12 will be resiliently deformed to a circular shape in conformity to the circular shape of the rear passageway portion 32. Once the socket retention portion 12 passes the rear shoulder 44 however, it again returns to an elliptical shape which has rear edge portions 13 at either end of the major diameter of the elliptical cross section. The edge portions 13 coming in contact with the rear shoulder portion 44 prevents the socket from being withdrawn through the rear passageway portion 32.

Figure 3:
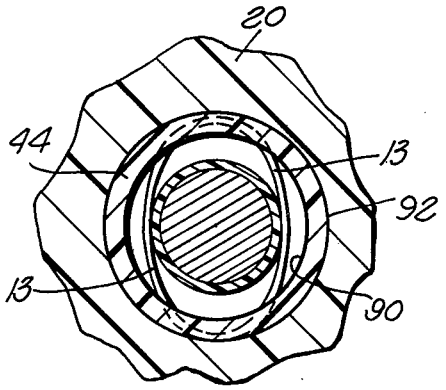
FIG. 3 is a cross-sectional plan view through section 3—3 of FIG. 2.

The above-described retention mechanism is illustrated in FIG. 3, which is a cross section through 3—3 showing the interior surface 92 of the socket retention portion 12 and the inside circular surface 90 of the rear passageway portion 32. The elliptical cross section of the socket retention portion edge 13 is shown in position and retained by the shoulder 44.

Returning to FIG. 2, the pin member 50 is shown in place in a pin insulator assembly comprised of a front pin insulator member 82 and a rear insulator member 80 which when connected together define a pin insert passageway having a front passageway portion 68 with a secondary front shoulder 74 for preventing the pin member 50 from passing through the pin insulator assembly. The pin insert passageway also comprises a central passageway portion 70 which has a larger diameter than the front passageway portion 68. A rear passageway portion 72 is defined by the rear insulator portion 80 which has a circular lip 42 which extends into the central passageway portion 70 to define a rear shoulder 84. In a manner similar to that previously described in conjunction with the socket member 10, a wire 78 is inserted into the pin member 50 and is held in place by the pin crimps 58. The pin engagement region 56 is then inserted into the rear passageway portion 72 and pressed through the pin insert passageway until the pin engagement region extends from the opposite end of the insulator assembly. As the pin retention portion 52 enters the rear passageway portion 72, the elliptical shape of the pin retention portion 52 is resiliently deformed to assume a circular cross section by the surface of the rear passageway portion 72. When the edge 88 of the pin retention portion 52 passes the rear shoulder 84, it again returns to an elliptical cross-sectional shape with the rear shoulder 84 preventing the pin member from thereafter being removed except with a removal tool.

Figure 4:
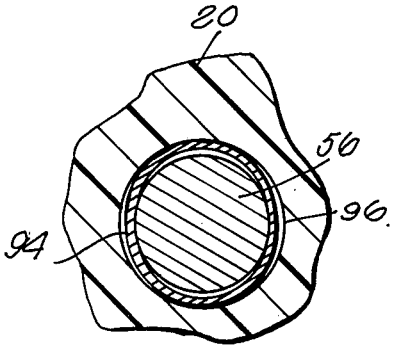
FIG. 4 is a cross-sectional plan view through section 4—4 of FIG. 2.

Referring now to FIG. 4, there is shown a cross section through 4—4 in FIG. 2 illustrating the circular cross section of the pin engagement region 56 in the preferred elliptical shape of the circular surface 96 of the front engagement passageway portion 46 of the socket member 10. The elliptical cross section 94 of the socket engagement region 16 is also shown to illustrate the low-resistance surface contact which may be provided by the present invention.

Although the socket member 10 and the pin member 50 are respectively retained in the pin insert passageway and the socket insert passageway by the shoulders 44 and 84, the socket member 10 and the pin member 50 may be easily removed by inserting a tool, having a longitudinal split tube configuration, into the rear entry of second central passageway portions 30 or 70, respectively, the leading edge of the longitudinal split tube tool is chamfered so that as the chamfered end enters the second central passageway portions 30 or 70, respectively, the elliptically shaped socket or pin retention portions 12 and 52, respectively, are formed by the tool into the circular shape which may then be withdrawn through the rear passageway portions 32 or 72 by pulling the socket 10 or pin 50, the wire and the tool together.

Thus, the present invention provides a rear insertable - rear releasable connector assembly without the necessity of a separate clip or retaining member to keep the socket member or the pin member in place in the insulated holder or retainer portion of the connector. What is claimed is:

1. A connector assembly for connecting a first set and a second set of wires comprising:

a socket assembly which comprises:

a socket insulating support having therethrough at least one socket insert passageway with a socket rear passageway portion with a circular cross section of a first diameter, and a socket central passageway portion with a circular cross section of a second diameter larger than the first diameter, the junction between the socket rear passageway portion and the socket central passageway portions defining a socket rear shoulder; and at least one electrically conducting tubular shaped socket member each having a front pin receptor region, a socket electrical contact region for attachment to one wire in the first set of wires and a rear elliptical socket retention portion, rearward of the socket electrical contact region, resiliently deformable to a circular shape for insertion and removal through the socket rear passageway portion and having a rear elliptical edge, the socket retention portion being positioned in the socket central passageway portion, the portion of the rear elliptical edge at the ends of the major axis of the ellipse of the socket retention portion, contacting the socket rear shoulder for preventing withdrawal of the socket member from the socket support;

a pin assembly comprising:

a pin insulating support having therethrough at least one pin insert passageway defining a pin rear passageway portion with a circular cross section of a first diameter, and a pin central passageway portion with a circular cross section of a second diameter larger than the first diameter, the junction between the pin rear passageway portion and the pin central passageway portions defining a pin rear shoulder; and at least one electrically conducting cylindrically shaped pin member, each having a front pin contact region adapted for being inserted into the pin receptor region of the socket member for providing an electrical contact between the pin member and the socket member, a pin electrical contact region for attachment to one of the wires in the second set of wires, and a rear elliptical cross-sectional pin retention portion, rearward of the pin electrical contact region, resiliently deformable to a circular shape for insertion through the pin rear passageway portion and having a rear elliptical edge, the pin retention portion being positioned in the pin central passageway portion of the pin insulating support, the portions of the rear elliptical edge at the ends of the major axis of the ellipse of the pin retention portion contacting the pin rear shoulder for preventing withdrawal of the pin member from the pin support.

2. The connector assembly of claim 1 wherein the pin receptor region has an elliptical cross-sectional shape resiliently deformable to a circular shape having an inside diameter and the pin contact region has a circular cross section having an outside diameter no larger than the inside diameter of the deformed circular shape of the pin receptor region for providing an electrical connection between the socket contact region and the pin contact region.

3. The connector assembly of claim 1 wherein each socket member is hollow for receiving, in the interior thereof, one wire from the first set of wires, and each pin member is hollow for receiving, in the interior thereof, one wire from the second set of wires.

4. A connector assembly for attachment to the end of at least one wire comprising:

an insulating support having therethrough at least one passageway having a rear passageway portion with a circular cross section of a first diameter and a central passageway portion with a circular cross section of a second diameter larger than the first diameter, the junction between the rear passageway portion and the central passageway portion defining a rear shoulder; and at least one electrically conducting tubular shaped connector member each having a front mating region, an electrical contact region for attachment to one of the wires and a rear elliptical retention portion, rearward of the electrical contact region, resiliently deformable to a circular shape for insertion and removal through the rear passageway portion, the elliptical socket retention portion having a rear elliptical edge, the retention portion being positioned in the central passageway portion of the insulating support, the major axis portion of the rear elliptical edge contacting the rear shoulder for preventing withdrawal of the connector member from the insulating support.

5. The connector assembly of claim 4 wherein each connector member is hollow for receiving, in the interior thereof, the one wire for attachment to the interior of the electrical contact region.

* * * * *